US007561707B2

(12) United States Patent
Kornagel

(10) Patent No.: US 7,561,707 B2
(45) Date of Patent: Jul. 14, 2009

(54) HEARING AID SYSTEM

(75) Inventor: Ulrich Kornagel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 789 days.

(21) Appl. No.: 11/185,297

(22) Filed: Jul. 20, 2005

(65) Prior Publication Data

US 2006/0018497 A1 Jan. 26, 2006

(30) Foreign Application Priority Data

Jul. 20, 2004 (DE) ..... 10 2004 035 046

(51) Int. Cl.
*H04R 5/02* (2006.01)
*H04R 1/40* (2006.01)
*H04R 25/00* (2006.01)

(52) U.S. Cl. ..... 381/310; 381/23.1; 381/97; 381/313

(58) Field of Classification Search ..... 381/23.1, 381/97, 310, 311, 313, 320, 17, 18, 19, 63, 381/74, 309; 715/727
See application file for complete search history.

(56) References Cited

U.S. PATENT DOCUMENTS 5,438,623 A 8/1995 Begault
5,524,150 A 6/1996 Sauer
6,307,941 B1 10/2001 Tanner, Jr. et al.
7,106,870 B2 9/2006 Meier et al.
2002/0151997 A1 10/2002 Wilcock et al.
2002/0159613 A1 * 10/2002 Killion ..... 381/315
2003/0059070 A1 3/2003 Ballas
2003/0190047 A1 * 10/2003 Aarts ..... 381/310
2005/0117761 A1 * 6/2005 Sato ..... 381/310
2006/0147068 A1 * 7/2006 Aarts et al. ..... 381/310

FOREIGN PATENT DOCUMENTS

DE 103 03 441 A1 9/2003
EP 0 557 847 B1 9/1993
EP 1420611 A1 5/2004
WO WO 03/015471 A2 2/2003

* cited by examiner

*Primary Examiner*—Curtis Kuntz
*Assistant Examiner*—Jesse A Elbin

(57) ABSTRACT

The user (2) of a binaural hearing aid or communication system (1A, 1B) is to be provided with an easier assignment or identification of acoustic signals generated in the system for keeping a user (2) informed about current settings or states of the system. To this end the signal is emitted by the hearing aid or communication system (1A, 1B) in such a way that for the user (2) the signals appear to come from different signal sources (3 to 6; 8 to 11) in the space (7) surrounding the user. In this way the acoustic signals carry additional information perceived consciously or unconsciously by the user (2).

8 Claims, 1 Drawing Sheet

HEARING AID SYSTEM

CROSS REFERENCE TO RELATED APPLICATIONS

This application claims priority to the German application No. 10 2004 035 046.9, filed Jul. 20, 2004 which is incorporated by reference herein in its entirety.

FIELD OF INVENTION

The invention relates to a hearing aid or communication system for binaural provision to a user, with acoustic signals being able to be generated to give the user information about settings or system states of the hearing aid or the communication system.

BACKGROUND OF INVENTION

Hearing aid systems with two hearing aid devices which can be worn on the head for binaural provision of a user are known from the prior art. Furthermore communication systems are known in which different acoustic signals can be directed to a user via at least two loudspeakers for the left ear and the right ear.

A sound output device for a motor vehicle is known from DE 103 03 441 A1. An output section consisting of a pair of loudspeakers which are arranged adjacent to one another, is installed in a seat backrest or in the back of a designated seat. The sound output surfaces of the loudspeakers point in each case towards the designated person who is sitting on the designated seat. This makes it easy to ensure that there is the distance required avail able to achieve a clear acoustic image localization in keeping with the size of loudspeakers, which work together to form the output section.

A hearing device that can be worn on the head is known from EP 0 557 847 B1, said device comprising an electrical signal path between a microphone and an earpiece, with the signal path being able to be adapted by using means to electronically adjust pre-programmable transmission parameters and a switching means of the hearing device to different hearing situations/sound environments, with the switching means additionally controlling a signal output device which emits at least one signal which is characteristic for the transmission parameters set for a specific hearing situation/sound environment, with the hearing device user being able to perceive this signal and being able to be informed about the selected setting without removing the hearing device from their head.

To determine the sound pressure which any given signal produces in front of a person's eardrum it is sufficient to know the impulse response between the source and the eardrum. This is referred to as the HRIR (Head Related Impulse Response). Its Fourier-transformed function is called the HRTF (Head Related Transfer Function). The HRTF comprises all physical characteristic values for localization of a signal source. If the HRTFs are known for the left and right ear this enables binaural signals of an acoustic source to be synthesized.

In a non-resonating environment the HRTF is a function of four variables: The three space coordinates (in relation to the head) and the frequency. For determining the HRTFs, measurements are mostly performed on an artificial head, e.g. KEMAR (Knowles Electronics Mannequin for Acoustical Research), A known overview of how HRTFs are determined can be found for example in Yang, Wonyoung, "Overview of the Head-Related Transfer Functions (HRTFs)", ACS 498B Audio Engineering, The Pennsylvania State University, July 2001.

It is known from the area of artificial head technology that direction-dependent transmission functions of the head and the outer ear can be simulated relatively precisely by multiple microphone arrangements in the free field with suitable downstream filters (e.g. Podlaszewski, Mellert: "Lokalisationsversuche for virtuelle Realität mit einer 6-Mikrofonanordnung" (Localization trials for virtual reality with a 6-microphone arrangement), DAGA 2001). The filters are designed here with a special optimization procedure so that the sum of the filtered microphone signals (typically 3 per side) for any given spatial directions, corresponds with a certain error tolerance to the sound signal which would be measured in the same situation at an artificial head.

SUMMARY OF INVENTION

An object of the present invention is, for the user of a hearing aid or a communication system, to enable acoustic signals for informing said user about settings or system states or the hearing aid or communication system to be better identified or more easily assign ed. This object is achieved by the claims.

The invention can be applied equally well to hearing aid or to communication systems. In this case a hearing aid system in accordance with the invention comprises two hearing aid devices worn on the head for binaural provision of a user. The hearing aid devices are coupled to each other in such a way that a precisely matched acoustic signal can be emitted in the left and in the right ear. Likewise, in a communication system in accordance with the invention, exactly matched, but generally slightly different acoustic signals can be created and directed to the user's left and right ear. This means that it is possible for the left and the right ear of a user to be fed acoustic signals which are slightly phase -shifted and adapted in their amplitude, so that the user gets that impression that an acoustic signal generated or stored in a hearing aid or communication system is coming from a specific direction of the space. The user thus gets the impression that the acoustic signal originates from an acoustic signal source with a certain position in the space. Since in reality there is no corresponding signal source at the corresponding position in the space, the source concerned is thus a virtual signal source The placing of this virtual signal source in the space is used in accordance with the invention to make the information contained in the acoustic signal more easily accessible for the user. In addition the placement of the virtual signal sources in the space can also enable additional information to be transmitted to the user. The acoustic information relates to current settings of the hearing aid or communication system, such as the volume set or the hearing program currently set as well as to specific system states, for example the current charge state of the power sources used.

Preferably the space surrounding the user is subdivided into different sectors in relation to a user who is looking straight ahead, in which the virtual signal sources are then placed. The sectors used should be selected so that the acoustic signals played can also be recognized as artificially created, i.e. as not really present. A cone section above or below a specific angle of elevation defined as symmetrical around the longitudinal axis of rotation of a user's head can serve as a sector here for example. The sectors could also be defined close to or above the head. The signal sources are preferably arranged so that it is intuitively clear to the user which information is to be transmitted by them. If for example a number of programs with different transmission functions can be set for the hearing aid or communication system, the associated program number can be identified on the basis of an individual tone which appears to originate from a point in the space assigned to this program number. For example the following assignment is sensible:

Program number 1=tone from left

Program number 2=tone from front left

Program number 3=tone from front right

Program number 4=tone from right.

For the example of acoustic indication of the state of battery charge a tone could be spatially virtually placed such that its spatial height symbolizes the level of the charge state. Since a continuous value is involved here, a virtual acoustic scale should additionally be included. This can be done by the tone initially running through the possible range of values, that is to say moving from bottom left to top right, and then directly thereafter coming from the direction which reflects the current charge state.

The principle of virtual spatial presentation of information can also be used for further not yet specified service features for hearing aid or communication systems. It can thus be employed as a universal additional degree of freedom for information transfer. For example a user can be informed in conjunction with a compass about where "North" is by a virtual acoustic signal originating from this direction being generated on request.

The virtual signal sources in the space are preferably arranged taking into account the given HRTF (head related transfer functions) of the two ears. This makes use of the fact that, with known impulse responses of the left or right ear in relation to a sound signal output from a point in the space, a fictional sound source lying at this point in the space can be simulated. To obtain the corresponding signals of a virtual signal source for the left or the right ear, the relevant acoustic signal is folded with the left or right HRIR (head related impulse response). What is important here is for the possibly asymmetrical behavior of the hearing aid or communication devices of the relevant hearing aid or communication systems not to destroy the spatial impression. This type of asymmetry can for example occur for hearing aid wearers as a result of the devices being set differently to allow for differences in hearing loss between the two ears. It may be that appropriate disturbance suppression measures then have to be performed to correct the asymmetry. It is important for both hearing aid or communication devices to provide the acoustic signal exactly synchronously so that the signal changes created by the relevant HRIR can also have an exact effect. For hearing aid or communication devices which operate asynchronously the time offset between the acoustic signals for the left and the right ear can cause an undesired spatial shift in the perception of the acoustic signal to occur. The precondition for a synchronous signal output is a coupling and synchronization of the two hearing aid or communication devices, in which difference in the clock frequency of the two devices must also be equalized where necessary.

The HRTF or HRIR are preferably determined at a KEMAR, a standardized artificial head. As a rule such measurements are sufficient. Better results are however achieved by individual measurements of the HRTF or HRIR on the user of the hearing aid or communication system.

With a simplified version of the invention only the delay time and/or level difference at the ears for the signals arriving at the ears from different directions is used for simulation of the signal sources in accordance with the invention. This setting is based on the knowledge that for example in reality sound arriving from the right is perceived earlier and more loudly by the right ear than it is by the left ear. This effect is used according to the invention for placing the virtual signal sources. An adequate synchronization of the two hearing aid or communication devices must also be guaranteed in this case.

BRIEF DESCRIPTION OF THE DRAWINGS

The invention is explained in more detail below on the basis of an exemplary embodiment. The figures show.

DETAILED DESCRIPTION OF INVENTION

Figure 1:
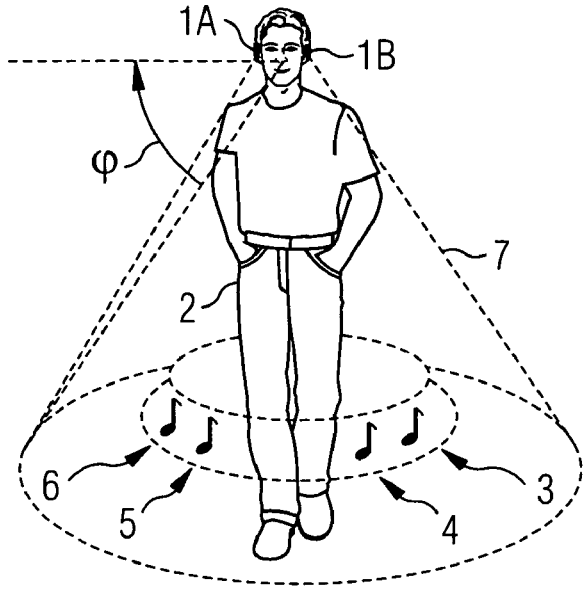
FIG. 1 a user provided by a hearing aid system who perceives virtual signal sources from different directions, FIG. 2 a user of a hearing aid system with virtual signal sources perceivable above the head and FIG. 3 a measuring arrangement for determining the HRIR.

FIG. 1 shows a user 2 who is wearing a hearing aid 1A behind his right ear and a hearing aid 1B behind his left ear. The two hearing aids 1A and 1B are coupled to each other by a wire connection or wirelessly, so that signals generated in the hearing aids 1A and 1B can be directed to the left ear and the right ear in a balanced way. In this way a slight phase shift and a slight change in the amplitudes in the signals fed to both ears can convey to the user 2 the impression that the signal is coming from a signal source which is taking up a particular position in the space. Since no such signal source is in actual fact present in the space, the signal is actually coming from a virtual signal source. A balanced change to the signals fed to the two ears of the user allows the virtual signal source to be moved around in the space in relation to a situation in which the user is looking straight ahead. The change to the position of the virtual signal source in the space is used to add additional information to the acoustic signal coming from the virtual signal source. This additional information can be perceived consciously or unconsciously by the user 2. In the exemplary embodiment the hearing programs identified by the numbers 1 through 4 can be set in the hearing aid system 1A, 1B. Switching between different hearing programs or an explicit request for the hearing program currently set informs the user 2 about the current hearing program set. This information can be provided for example in the form of a voice signal. To allow the different, voice outputs which depend on the current hearing program to be more easily identified the speech is output by a virtual signal source which takes up different locations in the space depending on the active hearing program. Thus in the exemplary embodiment the hearing program 1 is assigned the virtual signal source 3 in the left rear position in relation to the straight-ahead view of the user 2. Correspondingly the virtual signal source to announce hearing program 2 is in the left front position 4. Hearing program 3 is assigned the right front position 5 and hearing program 4 the position 6 to the right. In the exemplary embodiment all signal sources are on a cone surrounding the user 2 which lies rotationally symmetrical in relation to the longitudinal axis of the head of the user 2. By defining an angle of elevation $\phi$ sectors can be defined in the space within which the virtual signal sources are located. This enables the virtual signal sources to easily be placed in the space such that any confusion with natural sound sources is as a rule excluded. In the exemplary embodiment according to FIG. 1 the position of the virtual signal sources is limited to the space enclosed by the cone 7.

Figure 2:
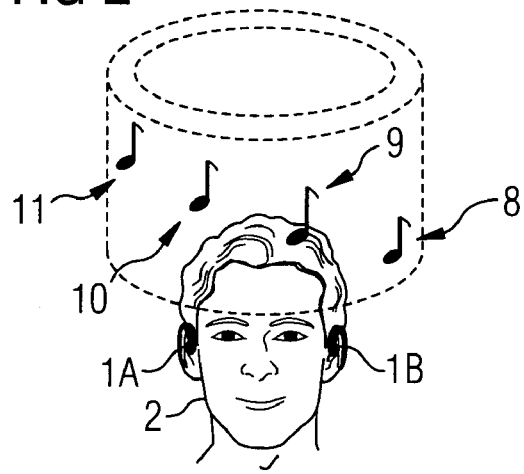

FIG. 2 shows a further exemplary embodiment of the invention. In this exemplary embodiment too provision to the user 2 is by two hearing aids 1A and 1B which are coupled as regards generated or stored signals emitted in the hearing aid system 1A, 1B. By contrast with FIG. 1, the exemplary embodiment in FIG. 2 does not show the current hearing program, but the current charge status of the power source used to supply energy to the two hearing aids 1A and 1B. In this embodiment it appears to the user 2 that a tone to indicate a discharged voltage source is coming from their left at about eye level. A full power source by contrast is indicated by a signal coming from the right above the user's head. To further clarify the condition of the power source, as the charge of the power source increases, the frequency and/or the volume and/or the duration of signal tone used can increase. Furthermore the hearing aid system 1A, 1B can be operated in such a way that the user 2 is initially presented with the possible values of charge states in the form of an acoustic scale. This can be done by the signal tone cycling continuously within a short period as regards the position of the virtual signal source as well as the signal frequency and volume for all possible charge states and subsequently by the signal representing the current charge state being created again, so that the user 2 can set the current charge state better in relation to the possible range of values. To this end FIG. 2 illustrates possible positions 8 to 11 of the virtual signal sources for indicating the charge state of the power source. To display the current value, after the virtual scale is indicated, the current value which for example is assigned to the position 10, is created once again.

Figure 3:
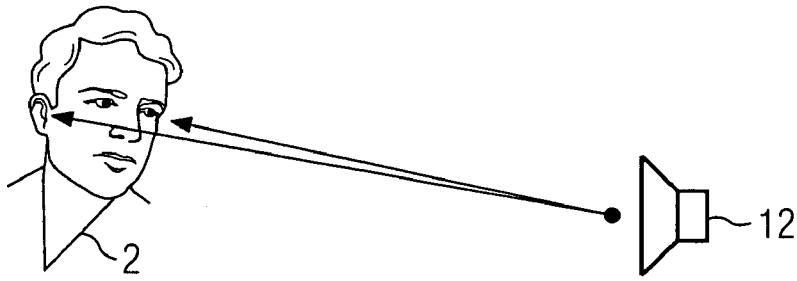

The phase shift and change to the volume of an acoustic signal which is directed to the left and the right ear are major characteristics for informing the user 2 about the direction from which the signal is entering. To cover almost the entire space surrounding the user 2 in three-dimensions further influencing factors must however be taken into account. These factors relate in particular to the anatomical circumstances of the head and also the ears, by which the sound signals arriving from a specific direction will be changed before they reach the eardrum of the relevant ear. Signal changes within this context can be described by the head related transfer functions (HRTF). To determine these transmission functions the head related impulse responses (HRIR) are measured. A corresponding measurement arrangement is reproduced in FIG. 3. In this the user 2 is located in a measurement environment and receives a specific sound signal by means of a loudspeaker 12 which represents the sound source. The acoustic signal directed to the user 2 by this arrangement is measured in his auditory canals by measuring recorders accommodated there (not shown). The comparison of the signal output with the signal measured in the auditory canal allows the HRIR or HRTF to be determined for the left and the right ear. If the HRTF or HRIR is now applied to a synthetic signal generated in the two hearing aids 1A and 1B in accordance with FIG. 1 or 2, the user 2 is given the impression that the signal is originating from a signal source which is located in the position of the loudspeaker 12 in accordance with FIG. 3.

The invention claimed is:

1. A hearing aid system for binaural supply of a user, comprising:

an acoustic signal output device having at least two loudspeakers; and an acoustic signal generator coupled to the acoustic signal output device for generating status signals acoustically perceivable by the user, the status signals representing a current setting or status of the hearing aid system, wherein the acoustic signal generator is adapted to generate the status signals such that the user perceives different status signals as originating from different spatial directions, wherein the user perceives the different status signals as originating from a plurality of virtual signal sources located in a room surrounding the user, wherein at least one of the virtual signal sources is located in a defined sector of the room, and wherein the sector is a rotation-symmetrical cone relative to a longitudinal body axis of the user.

2. The hearing aid system in accordance with claim 1, wherein the sector is limited by a specific angle of elevation.

3. The hearing aid system in accordance with claim 1, wherein the spatial direction, from which one of the status signals originates, changes while the one status signal is output by the acoustic signal output device.

4. The hearing aid system in accordance with claim 1, wherein the location of at least one of the virtual signal sources is based on the current setting or status of the hearing aid.

5. The hearing aid system in accordance with claim 1, wherein the virtual signal sources form a virtual scale.

6. The hearing aid system in accordance with claim 1, wherein the locations of the virtual signal sources are based on characteristics of the status signals.

7. The hearing aid system in accordance with claim 6, wherein the characteristics are a volume, a frequency, or a duration of the status signals.

8. The hearing aid system in accordance with claim 1, wherein the locations of the virtual signal sources are determined using Head Related Transfer Functions.

* * * * *